US007811028B1

(12) United States Patent
de la Rosa et al.

(10) Patent No.: US 7,811,028 B1
(45) Date of Patent: Oct. 12, 2010

(54) HOODED CHECK TUBE

(75) Inventors: Mary de la Rosa, Madison, WI (US); William T. Graham, Evansville, WI (US); William N. Isermann, Marshall, WI (US); Mark Doudlah, Evansville, WI (US); Robert Walker, Edgerton, WI (US); Paul Collins, Janesville, WI (US); Jay Settersten, Cambridge, WI (US)

(73) Assignee: Agrecol, LLC, Madison, WI (US)

( * ) Notice: Subject to any disclaimer, the term of this patent is extended or adjusted under 35 U.S.C. 154(b) by 168 days.

(21) Appl. No.: 12/028,557

(22) Filed: Feb. 8, 2008

Related U.S. Application Data

(60) Provisional application No. 60/889,193, filed on Feb. 9, 2007.

(51) Int. Cl.
*E02B 3/04* (2006.01)

(52) U.S. Cl. ..... 405/15; 405/302.6

(58) Field of Classification Search ..... 405/302.4, 405/302.6, 302.7, 91, 107, 110–111, 115, 405/15–17, 19, 21; 53/469; 383/2, 107, 383/37; 206/321, 538; 220/526, 571, 573, 220/4.28, 6

See application file for complete search history.

(56) References Cited

U.S. PATENT DOCUMENTS 6,527,477 B1 3/2003 Allard
6,641,335 B1 11/2003 Allard
6,749,748 B1 6/2004 Macpherson et al.
6,893,193 B2 5/2005 Santha
6,913,423 B2 7/2005 Spangler et al.
7,056,057 B2 6/2006 Marchant
2006/0127182 A1 * 6/2006 Sanguinetti ..... 405/20
2007/0003369 A1 * 1/2007 Hanson et al. ..... 405/19

FOREIGN PATENT DOCUMENTS

WO WO 9411582 A1 * 5/1994

* cited by examiner

*Primary Examiner*—Sunil Singh
(74) *Attorney, Agent, or Firm*—Michael Best & Friedrich LLP

(57) ABSTRACT

A check tube is sealed on one end and may be open on the opposite end. The check tube may have a cape, a flap and/or a hood attached to the check tube to, among other things, anchor the check tube and/or to prevent water flow, and thus erosion, between adjacent check tubes, beneath the check tube and/or downstream of the check tube. A temporary pocket defining a subset of the volume of the check tube is provided in the check tube and filled with fill material that expands after being introduced to water. Just prior to, during or after installation of the check tube, the pocket is opened, broken or dissolved and the check tube is introduced to water thereby allowing the fill material to expand to the full volume of the check tube.

13 Claims, 2 Drawing Sheets

HOODED CHECK TUBE

BACKGROUND OF THE INVENTION

This invention is directed to a measure to help control water, erosion and sediment run-off. More particularly, the invention relates to a check tube and system to control water and/or sediment flow.

This application claims priority to U.S. Provisional Application 60/889,193, filed Feb. 9, 2007, which is incorporated herein by reference in its entirety.

Ditch checks or check tubes are often used in areas of low elevation relative to the surrounding ground in order to slow the rate of water flow through the area. By slowing the rate of water flow, erosion can be reduced and silt is encouraged to settle in the areas of reduced water flow. Ditch checks can be made of natural inorganic materials, such as rocks, and/or natural organic materials, such as hay. Alternatively, check tubes can be manufactured using a variety of appropriate materials which may include natural and/or organic materials.

Some of the manufactured check tubes use an expanding material that significantly increases in size and weight when introduced to water. Some of the advantages of these types of check tubes are a reduction in preinstalled size and weight and simpler installation resulting from the reduced size and weight. During or after installation, when the check tube becomes wet, some or all of the material in the check tube will expand.

Check tubes with expanding material are often constructed as a hollow sleeve that is only partially filled with the expanding material. The check tube is only partially filled so as to allow for expansion of the fill material. As the check tube gets wet, the material inside expands and fills the check tube.

SUMMARY OF DISCLOSED EMBODIMENTS

However, since prior to installation, the material only fills a portion of the check tube, the material is largely free to move around the check tube. During transport and installation of the check tube, the fill material may move around resulting in some areas of the check tube being over-filled with the fill material, while other areas are under-filled with the fill material. The check tube can not be properly used in this condition. When the fill material gets wet it will expand, causing areas that are over-filled with fill material to expand improperly and/or rupture or otherwise damage the check tube. Likewise, in the areas that are under-filled with the fill material, the check tube may be ineffective at slowing the rate of water flow as it will not expand to the proper dimensions.

It can be difficult, time consuming and/or expensive to assure that the fill material is evenly distributed throughout the check tube prior to and/or during installation. It would be advantageous to be able to assure that the fill material would be evenly distributed during manufacture and would stay evenly distributed up to or throughout the installation of the check tube.

By holding the fill material in a limited space throughout the length of the check tube during manufacture and up to or throughout the installation of the check tube, it can be assured that the fill material is evenly distributed before it is introduced to water and thus expands. During or after the installation, the fill material can then be released so as to be free to expand throughout the entire volume of the tube after being introduced to water.

This invention provides a check tube for erosion control.

This invention separately provides a check tube that is partially filled with a fill material that expands during or after installation to increase the size and/or weight of the check tube.

This invention separately provides a check tube with a defined subsection of its volume that is separated from the rest of the check tube. The subsection is filled or nearly filled with a fill material during manufacture.

This invention separately provides a check tube with a hood to overlap or enmesh with another check tube.

This invention separately provides a check tube with a check flap to, among other things, help hold the check tube in place during installation.

This invention separately provides a check tube with a second flap or cape to help prevent erosion around the check tube.

In various exemplary embodiments of a check tube according to this invention, the check tube is filled with a fill material that expands when introduced to water. In such exemplary embodiments, the check tube is kept dry or mostly dry until or throughout the installation of the check tube. At that time, it is introduced to water and the fill material expands.

In various exemplary embodiments of a check tube according to this invention, the check tube is only partially filled with fill material that will expand after being introduced to water. In various ones of these exemplary embodiments the fill material is restricted to a subsection of the volume of the check tube until or through the installation of the check tube. In various ones of these exemplary embodiments the fill material is then unrestricted to the entire volume of the check tube before being introduced to water and thus expanding.

In various exemplary embodiments of a check tube according to this invention, the check tube has a secondary stitch that defines a subsection or pocket of the volume of the check tube. In various ones of these exemplary embodiments the subsection of the volume is filled with a fill material that expands after being introduced to water. In various ones of these exemplary embodiments the secondary stitch is removed just prior to, during or just after installation of the check tube to allow the fill material to expand throughout the entire volume of the check tube after being introduced to water.

It should be appreciated that the fill material can be restricted to a subset of the volume of the check tube for any length of time between the manufacture of the check tube and the actual use of the check tube. In some instances it may be beneficial and/or necessary to completely install the check tube before unrestricting the fill material. In other instances it may be beneficial and/or necessary to restrict the fill material to a subset of the volume of the check tube until just before installation and to install the check tube with the fill material unrestricted to the entire volume of the check tube.

In various exemplary embodiments of a check tube according to this invention, the check tube has a hood. In various ones of these exemplary embodiments the hood is attached to a first end of the check tube and is usable to overlap or enmesh with a second end of a second similarly constructed check tube. In such exemplary embodiments, the hood restricts water from flowing freely between two adjacent check tubes and allows construction of a check tube system made of any desired number of individual check tubes.

In various exemplary embodiments of a check tube according to this invention, the check tube has a check flap. In various ones of these exemplary embodiments, the check flap is installed beneath the surface of the ground that the check tube is installed upon. In such exemplary embodiments the check flap helps hold the check tube in place during and/or after installation and/or helps prevent water from undercutting and flowing beneath the check tube.

In various exemplary embodiments of a check tube according to this invention, the check tube has a second flap or cape. In various ones of these exemplary embodiments, the second flap or cape extends across the entire length of the check tube on the downstream side of the check tube. In such exemplary embodiments the second flap or cape dissipates water fall energy and prevents erosion on the downstream side of the check tube.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein.

DETAILED DESCRIPTION OF EXEMPLARY EMBODIMENTS

Figure 1:
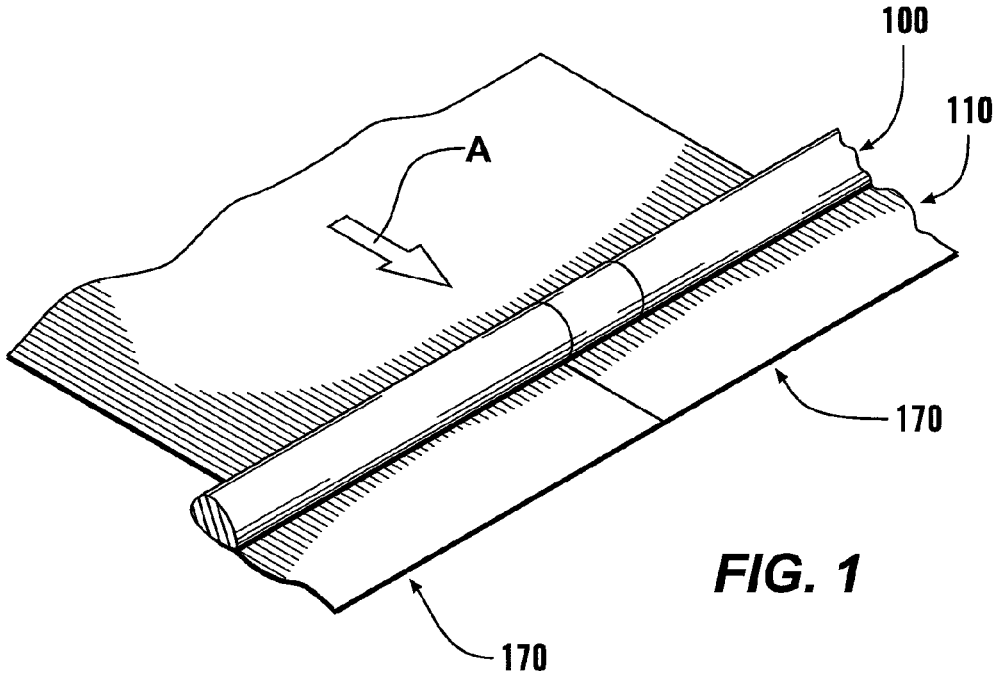
FIG. 1 is a perspective view of a plurality of check tubes shown installed according to one embodiment of the present invention.

FIG. 1 shows a barrier 100 comprising an exemplary embodiment of a check tube 110. In one embodiment, the barrier 100 is installed on the ground or another surface at a determined location, such as across a ditch or swale that occasionally carries water, or perpendicular to an expected flow. In one embodiment, one or more check tubes 110 are aligned to extend substantially transversely across the ditch or swale. Adjacent check tubes 110 are aligned relative to each other for sufficient overlap of the sides, as more fully explained below. In FIG. 1, arrow A indicates a downstream direction of water and/or sediment flow.

Figure 2:
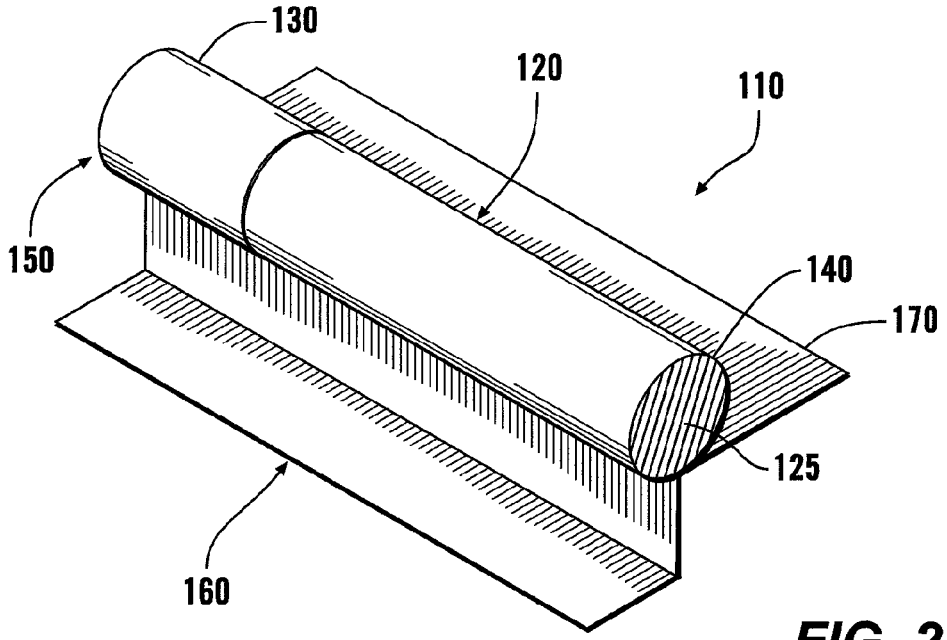
FIG. 2 is a perspective view of one exemplary embodiment of a check tube.

FIG. 2 shows a first exemplary embodiment of a check tube 110. The check tube 110 comprises a sleeve 120, a first end 130 and a second end 140. In this exemplary embodiment, the check tube 110 is an elongate member having a longitudinal axis and defining a longitudinal cross-section resembling any closed shape, such as, for example, a circle, a non-circle such as an oval, and/or a polygon such as a square. In various exemplary embodiments, the first end 130 of the sleeve 120 is substantially closed. For example, the first end 130 of the sleeve 120 may be stitched shut. As shown, the second end 140 of the sleeve 120 may be open. As discussed below, the second end 140 may also be substantially closed.

In various exemplary embodiments, a hood 150 is attached to the first end 130 of the sleeve 120. The hood 150 allows the check tube 110 to overlap or enmesh with another check tube 110. By enmeshing two or more adjacent check tubes 110, a check tube system, such as the barrier 100 shown in FIG. 1, can be constructed of any desirable length. Furthermore, the hood 150 restricts water from flowing freely between adjacent check tubes 110 thus preventing erosion between the adjacent check tubes 110. It should be appreciated that any two adjacent check tubes 110 may be installed at any desirable angle to each other and that the flexible nature of the hood 150 may assist in enmeshing the check tubes 110 at angles other than one hundred eighty degrees (as shown in FIG. 1).

The second end 140 of the check tube 110 is generally left open to allow the check tube 110 to be filled at least partially with filler material 125. The filler material 125 may comprise any number of materials. For example, the filler material 125 may be completely organic or may include polymer. For example, the filler material 125 may be comprised of native pellets and/or a polyacrylamide mix. The native pellets are composed of leaves, stems, stalks and/or other biomass material or natural components that are consistent with the native vegetation of the area where the check tube 110 is to be used. The material used to make the pellets is heated and compressed, thus rendering it substantially sterile. Any type of filler material 125 that absorbs water may be used to at least partially fill the check tube 110.

The check tube 110 may be formed of a water-permeable material. In various exemplary embodiments, the check tube 110 will be formed of non-woven needle-punched polypropylene fabric.

Figure 3:
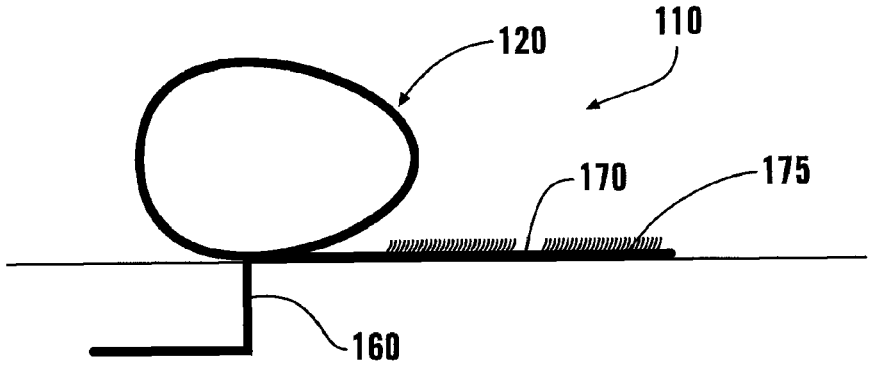
FIG. 3 is a side view of an exemplary embodiment of a check tube.

As shown in FIGS. 2-3, the check tube 110 of the present invention may also comprise a check flap 160. During installation of the check tube 110, the check flap 160 may be buried below grade to help hold the check tube 110 in place and to prevent water from undercutting the check tube 110 and/or eroding the ground, soil or other surface near the check tube 110. The check flap 160 may also eliminate the necessity for installation of stakes or staples or other such apparatus to help hold the check tube 110 in place relative to the ground or other surface. However, such stakes or staples may be used to anchor the check tube 110 and/or check flap 160, if desired.

The check tube 110 of the present invention may also comprise a cape flap 170. In various exemplary embodiments, and as shown in FIGS. 1-3, the cape flap 170 is connected to the sleeve 120 and positioned to prevent erosion on the downstream side of the check tube 110. The cape flap 170 may help dissipate water fall energy as the water flows over the top of the sleeve 120 and thus may help prevent the formation of an erosion channel. The cape flap 170 also prevents water from back-flowing and eroding soil beneath the check tube 110.

In various exemplary embodiments the cape flap 170 is covered with vegetation 175. In such exemplary embodiments, the vegetation 175 helps anchor the cape flap 170, and thus the check tube 110, in place while increasing overall structural support. The cape flap 170, and the accompanying vegetation 175, may also help decrease the velocity of water flowing over the check tube 110.

Figure 4:
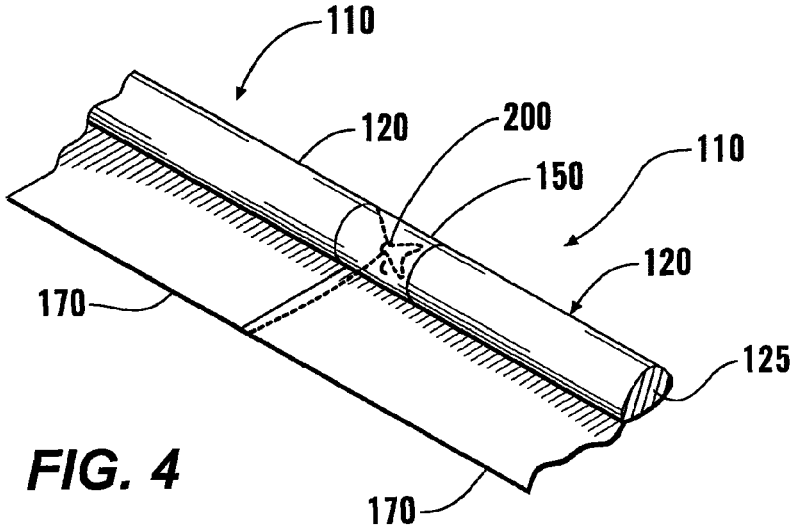
FIG. 4 is a perspective view of a plurality of check tubes installed according to one embodiment of the present invention.

As shown in FIG. 4, after the filler material 125 is inserted into the sleeve 120, the second end 140 of the check tube 110 may be at least substantially sealed or closed. For example, in various exemplary embodiments, the second end 140 may be tied using a tying apparatus 200, such as a plastic electrical tie, which may be punched through the material comprising the check tube 110 at a desired point and then pulled tight.

In various exemplary embodiments, a plurality of these check tubes 110 may be installed adjacent to each other. In various exemplary embodiments, the first check tube 110 may be positioned as desired. A second check tube 110 should be positioned adjacent to the first check tube 110. In various exemplary embodiments the second check tube 110 may be at least partially covered by the hood 150 of the first check tube 110 as shown in FIGS. 1 and 4.

Figure 5:
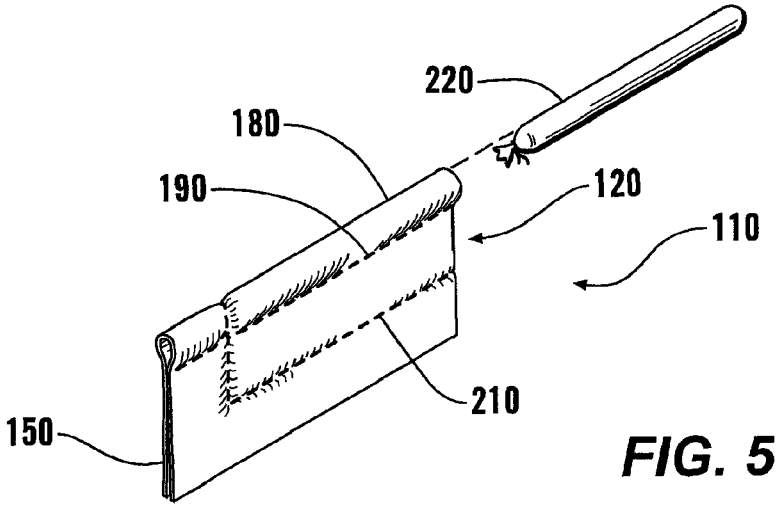
FIG. 5 is a view of an exemplary embodiment of a check tube of the present invention.

As shown in FIG. 5, the check tube 110 of the present invention may also comprise a pocket 180 provided in the sleeve 120. In various exemplary embodiments, the pocket 180 is used to help maintain the filler material 125 evenly along the length of the sleeve 120 during transport and installation. In various exemplary embodiments, the pocket 180 is created by gluing a portion of the sleeve 120 together with non-toxic water-soluble glue along a longitudinal glue line to subdivide the sleeve 120 as desired. When water is introduced to the check tube 110, the glue used to form the pocket 180 will dissolve and allow the filler material 125 to expand and fill the sleeve 120. In various exemplary embodiments, a temporary stitching line 190 may be used instead of a glue line to create the pocket 180 in the sleeve 120. The temporary stitching line 190 used to form the pocket 180 in the sleeve 120 may be removed after installation. For example, in various exemplary embodiments, the temporary stitching line 190 may be a chain stitch that allows easy removal of the temporary stitching line 190 by simple pulling of a loose end of the temporary stitching line 190 to permit the filler material 125 to expand within the sleeve 120 as needed or desired. In various exemplary embodiments, the pocket 180 may comprise a smaller tube 220 comprised of fabric and containing filler material 125 and other material, which fabric either dissolves or expands when water is introduced. Such a tubular pocket 220 may be inserted into the sleeve 120 during installation. In such exemplary embodiments, the glue and/or temporary line of stitching 190 may not be necessary.

In various exemplary embodiments, and as shown in FIG. 5, the check tube 110 will be fabricated from a single piece of material. For example, in various exemplary embodiments, the check tube 110 may be fabricated from a single sheet of material folded over upon itself and closed with a line of stitching 210 or otherwise sealed or closed as shown in FIG. 5, wherein the sleeve 120 is defined by portions of the folded sheet and fastening elements such as the line of stitching 210.

FIG. 5 also illustrates the use of temporary fastening elements, such as a line of chain stitching 190 which extends from the open end of the check tube 110 to subdivide the sleeve 120 into a smaller pocket 180 for receiving the filler material 125 and maintaining a generally even distribution of the filler material 125 along the entire length of the pocket 180 and/or sleeve 120 during storage, transport, handling and installation of the check tube 110. Although not necessary for the subdivision of the sleeve 120, the chain stitching line 190 is shown extending beyond the stitched closed end of the sleeve 120 toward the far end of the folded check tube 110. This simplifies the stitching step, and has the additional advantage that the chain stitching line 190 must be removed to permit nesting of the tied end of the sleeve 120 within the hood 150 of a previously placed check tube 110, as shown in FIG. 4. This prevents the installers from forgetting to remove the chain stitching 190 during installation of each check tube 110.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

The invention claimed is:

1. A check tube system, comprising:

a water permeable sleeve having a longitudinal length, a first end and a second end, the first end being closed;

a water permeable pocket within the sleeve, the pocket for receiving a filler material expandable beyond a volumetric capacity of the pocket to thereby fill the sleeve;

a hood attached to the second end of the sleeve;

a check flap attached to and extending the longitudinal length of the sleeve; and a cape flap attached to and extending the longitudinal length of the sleeve.

2. The check tube system of claim 1, wherein the sleeve supports the pocket.

3. The check tube system of claim 1, wherein the sleeve defines at least a portion of the pocket.

4. A check tube, comprising:

a water pervious material folded to form a double thickness defined by two opposed sheet portions joined along a longitudinally extending folded edge;

said sheet portions each defining a first pair of end edges extending at an angle from a first end of the folded edge, and a second pair of end edges extending at an angle from a second end of the folded edge, each sheet portion having an opposite edge extending between the distal ends of the first and second end edges in spaced relation to the folded edge;

a sleeve portion defined by fastening elements securing one sheet portion to the other sheet portion along a first line extending in generally spaced relation to the folded edge from adjacent first end edges of the sheets toward the opposite second end edges of the sheets for a substantial portion of the length of the sheets, and then along a second line extending from the first line to the folded edge, the sleeve portion further having a closed end defined by the second line of the fastening elements, opposed sides defined by the portions of the two sheets between the longitudinally extending folded edge and the first line of the fastening elements, and an open end defined by the first end edges extending between the folded edge and the first line of the fastening elements;

a temporary line of fastening elements extending from the first edges along a third line lying between and spaced from each of the folded edge and the first line of fastening elements to at least the second line of fastening elements to subdivide the sleeve into a smaller pocket portion, the pocket portion configured to receive and retain dry water absorbent filler material in an evenly distributed manner along the entire length of the pocket during storage, transport and installation of the check tube, the temporary line of fastening elements being adapted for easy removal after installation to permit generally uniform expansion of the filler material along the length and width of the sleeve upon absorption of water;

a hood defined by the portions of the sheets and the folded edge extending between the second end edges of the sheets and the second line of fastening elements;

a first flap formed by the first sheet portion between its first and second end edges and between its opposite edge and the first line of fastening elements;

a second flap formed by the portion of the second sheet extending between its first and second end edges and between its opposite edge and the first line of fastening elements; and the first and second flaps being adapted to extend in opposite directions from the first line of fastening elements to cover or be embedded in a supporting soil surface and/or other surface to permit water or other liquid to flow through the pervious sleeve and the filler material.

5. The check tube of claim 4, wherein a second check tube of similar construction may be nested with the first check tube, wherein the gathered and closed end of the second check tube sleeve is adapted to be inserted within the hood of the first check tube with the sleeves of the nested check tubes in axial alignment, and the first and second flaps of the second check tube are adapted to extend outwardly from its first line of fastening elements partially beneath the first and second flaps of the first check tube, respectively.

6. The check tube of claim 4, wherein the temporary line of fastening elements comprises a strip of water soluble glue which will be dissolved upon contact with ambient water flowing through the sleeve to permit expansion of the water absorbent filler material to occupy the full dimensions of the sleeve.

7. The check tube of claim 4, wherein the temporary line of fastening elements comprises a line of chain stitching which can be removed by pulling a loose end of the line of chain stitching to permit the filler material to expand upon wetting to occupy the full dimensions of the sleeve.

8. The check tube of claim 4, wherein a tube of smaller dimensions than the sleeve is contained within the pocket, the tube being adapted to contain said filler material, and wherein the tube comprises a fabric body which is adapted to dissolve or expand upon water contact to permit the filler material to expand to the full dimensions of the sleeve.

9. A check tube system comprising:

a water permeable sleeve having a longitudinal length, a first end, a second end, and a first volumetric capacity, the first end being closed;

a water permeable pocket within the sleeve, the pocket having a first state wherein the pocket has a second volumetric capacity substantially less than the first volumetric capacity, and a second state wherein the pocket is substantially open to the first volumetric capacity;

a hood attached to the second end of the sleeve;

a check flap formed as a unitary extension of the sleeve and extending the longitudinal length of the sleeve; and a cape flap formed as a unitary extension of the sleeve and extending the longitudinal length of the sleeve.

10. The check tube of claim 9, wherein the pocket transitions from the first state to the second state upon contact with water.

11. The check tube of claim 9, wherein the pocket transitions from the first state to the second state upon the selective removal of a line of stitches from the pocket.

12. The check tube of claim 9, further comprising a water-absorbent filler material which is substantially dry during storage, transport and installation of the check tube and which undergoes substantial volumetric expansion upon contact with water.

13. The check tube of claim 12, further comprising a water-absorbent filler material that substantially occupies the second volume when dry, and operable to substantially occupy the first volume after contact with water.

* * * * *